US012202659B2

(12) United States Patent
Holka

(10) Patent No.: US 12,202,659 B2
(45) Date of Patent: Jan. 21, 2025

(54) METHOD OF PRODUCING PACKAGING CONTAINER COMPRISING A VALVE

(71) Applicant: GPI Systems AB, Lund (SE)

(72) Inventor: Simon Holka, Staffanstorp (SE)

(73) Assignee: GPI Systems AB, Lund (SE)

( * ) Notice: Subject to any disclaimer, the term of this patent is extended or adjusted under 35 U.S.C. 154(b) by 18 days.

(21) Appl. No.: 18/200,658

(22) Filed: May 23, 2023

(65) Prior Publication Data

US 2023/0382611 A1 Nov. 30, 2023

(30) Foreign Application Priority Data

May 25, 2022 (SE) ..... 2250621-6

(51) Int. Cl.
*B65B 31/04* (2006.01)
*B65D 43/16* (2006.01)
(Continued)

(52) U.S. Cl.
CPC ..... *B65D 51/1644* (2013.01); *B65B 31/047* (2013.01); *B65D 51/20* (2013.01); *B65D 43/164* (2013.01)

(58) Field of Classification Search
CPC ... B65B 1/00; B65B 1/02; B65B 7/285–2892; B65B 7/2821; B65B 31/00;
(Continued)

(56) References Cited

U.S. PATENT DOCUMENTS 1,064,787 A 6/1913 Taylor
1,396,282 A 11/1921 Penn
(Continued)

FOREIGN PATENT DOCUMENTS

CH 280201 A 1/1952
CN 88102720 A 11/1988
(Continued)

OTHER PUBLICATIONS

Machine Translation of WO 2019/068384 A1 (2019).
European Search Report for EP 23 17 5363 dated Nov. 23, 2023.
Machine Translation of JP S58-216539 A to Tomoo (Year: 1983).

*Primary Examiner* — Stephen F. Gerrity
*Assistant Examiner* — Linda J Hodge
(74) *Attorney, Agent, or Firm* — Womble Bond Dickinson (US) LLP

(57) ABSTRACT

The present disclosure relates to methods of producing a packaging container for bulk solids. The packaging container has an inner compartment and a transport closure closing the inner compartment, the transport closure being provided with a pressure relief valve, the method includes the steps of forming a tubular container body having an upper body opening; presenting the container body to an upper body opening sealing station comprising a plunger piston comprising a bottom plate, the bottom plate having a through hole; closing the upper body opening by pressing the transport closure into the upper body opening such that a pressure above an ambient pressure is produced within the tubular container body, allowing gas to exit the valve and the valve to be pre-conditioned; and attaching the transport closure to the container body wall.

24 Claims, 5 Drawing Sheets

(51) Int. Cl.
*B65D 51/16* (2006.01)
*B65D 51/20* (2006.01)

(58) Field of Classification Search
CPC ..... B65B 31/047; B65B 51/144; B65B 55/00; B65B 61/182; B65D 51/1644; B65D 51/20; B65D 43/162; B65D 43/164; B65D 47/06; B65D 53/00; B65D 77/225; B65D 31/00; B31B 50/0044; B31B 50/8122; B31B 50/814; B31B 50/26; B31B 50/44; B31B 50/85; B31B 2110/35; B31B 2105/0022; B31B 2120/10
USPC ..... 53/432, 433, 456, 478, 485–489
See application file for complete search history.

(56) References Cited

U.S. PATENT DOCUMENTS 1,515,277 A 11/1924 Root
1,534,803 A 4/1925 Moore
1,733,674 A 10/1929 Leiman
2,073,636 A 3/1937 Holoubek
2,076,407 A 4/1937 Mandell
2,281,854 A 5/1942 Miller, Jr.
2,314,338 A 3/1943 Graves
2,317,651 A 4/1943 Talbot
2,324,670 A 7/1943 Bergen
2,348,377 A 5/1944 Goodyear
2,371,173 A 3/1945 Hothersall
2,409,655 A 10/1946 Annen
2,568,697 A 9/1951 Amberg
2,569,851 A 10/1951 Farrell
2,608,341 A 8/1952 Eckman
2,760,629 A 8/1956 Thagard, Jr.
2,795,366 A 6/1957 Magill
2,832,514 A 4/1958 O'Connor
2,891,713 A 6/1959 O'Neil
2,898,025 A 8/1959 Walker
2,923,453 A * 2/1960 Eckman ..... B29C 66/8322 229/125.17
2,948,454 A 8/1960 Gillmore
3,042,285 A 7/1962 Smith
3,042,288 A 7/1962 Carpenter, Sr.
3,049,277 A 8/1962 Shappell
3,101,885 A 8/1963 Walsh
3,109,576 A 11/1963 Karl
3,195,763 A 7/1965 Fried et al.
3,195,799 A 7/1965 Denenberg
3,391,852 A 7/1968 Waldrop
3,401,824 A 9/1968 Rouse
3,402,876 A 9/1968 Kuchenbecker
3,409,206 A 11/1968 Slouka et al.
3,445,049 A 5/1969 Carpenter, Jr.
3,506,183 A 4/1970 Turpin et al.
3,655,111 A 4/1972 Surerus
3,669,346 A 6/1972 Leezer et al.
3,696,987 A 10/1972 Schuff
3,940,496 A 2/1976 Turpin et al.
4,078,686 A 3/1978 Karesh
4,091,929 A 5/1978 Krane
4,091,984 A 5/1978 McFarland
4,198,901 A 4/1980 Knudsen
4,207,725 A 6/1980 Smith
4,210,618 A 7/1980 Piltz
4,495,209 A 1/1985 Whiteside
4,533,063 A 8/1985 Buchner et al.
4,556,152 A 12/1985 Bogren
4,606,462 A 8/1986 Bogren
4,621,736 A 11/1986 Roccaforte
4,632,298 A 12/1986 Schellengerg
4,720,038 A 1/1988 Shepard
4,736,870 A 4/1988 Christensson
4,804,101 A 2/1989 Heath
4,850,503 A 7/1989 Larsson
4,865,203 A 9/1989 Ueda
4,883,193 A 11/1989 Christensson
4,888,222 A 12/1989 Gibbons
4,921,121 A 5/1990 Duvander et al.
4,930,682 A 6/1990 Gordon et al.
5,305,583 A * 4/1994 Linner ..... B29C 66/542 53/329.2
5,407,107 A 4/1995 Smith
5,487,506 A 1/1996 Drummond et al.
5,511,680 A 4/1996 Kinne
5,514,394 A 5/1996 Lenahan
5,566,529 A 10/1996 Sireix
5,617,705 A 4/1997 Sanfilippo et al.
5,641,118 A 6/1997 Benham
5,685,480 A 11/1997 Choi
5,752,646 A 5/1998 Sandstrom
5,803,294 A 9/1998 Bello et al.
5,820,016 A 10/1998 Stropkay
5,897,019 A 4/1999 Stropkay
5,950,917 A 9/1999 Smith
6,047,878 A 4/2000 Lowry
6,092,717 A 7/2000 Lowry
6,165,114 A 12/2000 Stahlecker et al.
6,251,203 B1 6/2001 Vala et al.
6,325,232 B1 12/2001 Luttmann
6,415,940 B1 7/2002 Brabson, II
6,450,351 B1 9/2002 Thompson
6,644,541 B2 11/2003 Stewart
6,761,279 B1 7/2004 Martin et al.
7,169,418 B2 1/2007 Dalton
7,201,714 B2 4/2007 Zoeckler et al.
7,370,788 B1 5/2008 Otani et al.
7,703,625 B2 4/2010 Westphal
7,757,879 B2 7/2010 Schuetz
7,798,319 B1 9/2010 Bried
8,025,171 B2 9/2011 Cassol
8,220,701 B2 7/2012 Fontaine et al.
8,317,671 B1 11/2012 Zoeckler
8,403,819 B2 3/2013 Zoeckler
8,403,820 B2 3/2013 Zoeckler
8,684,224 B2 4/2014 House
8,915,395 B2 12/2014 Gersovitz
9,387,963 B2 7/2016 McBroom
9,718,574 B2 8/2017 Sireix
9,815,579 B2 11/2017 Larsson et al.
9,821,527 B2 11/2017 Hagelqvist
9,957,081 B2 5/2018 Gayer
9,975,305 B2 5/2018 Strand et al.
10,370,158 B2 8/2019 Herlin et al.
10,730,660 B2 8/2020 Herlin et al.
10,736,468 B2 8/2020 Herlin et al.
10,787,280 B2 9/2020 Herlin et al.
11,111,062 B2 9/2021 Herlin et al.
11,192,688 B2 12/2021 Herlin et al.
2002/0107127 A1 8/2002 Buisson
2002/0130126 A1 9/2002 Rosenberg
2003/0111522 A1 6/2003 Deering et al.
2003/0183540 A1 10/2003 Onishi
2004/0050437 A1 3/2004 Engel et al.
2004/0142133 A1 7/2004 De Coninck
2004/0206052 A1 10/2004 Shean
2004/0238553 A1 12/2004 Lane et al.
2005/0051461 A1 3/2005 Bryant
2005/0108990 A1 * 5/2005 Kahn ..... B65B 31/06 53/374.9
2005/0173501 A1 8/2005 Jones
2005/0189406 A1 9/2005 Welchel et al.
2005/0190995 A1 9/2005 Koyanagi
2005/0223680 A1 10/2005 Sireix
2005/0252952 A1 11/2005 Nomula
2006/0057315 A1 3/2006 De Coninck et al.
2006/0124719 A1 6/2006 Mannlein
2006/0254942 A1 11/2006 Cargile, Jr.
2006/0257534 A1 11/2006 Maddock
2006/0289542 A1 12/2006 Schedl
2007/0090105 A1 4/2007 Elgebrant
2007/0145001 A1 6/2007 Tilto
2007/0157577 A1 7/2007 Buisson
2007/0170236 A1 7/2007 Rasanen
2007/0234667 A1 10/2007 Lubker et al.

(56) References Cited

U.S. PATENT DOCUMENTS

| | | | | |
|---|---|---|---|---|
| 2007/0235512 | A1 | 10/2007 | Drummond | |
| 2008/0041861 | A1 | 2/2008 | Crawford et al. | |
| 2008/0110896 | A1 | 5/2008 | Westphal | |
| 2008/0156805 | A1 | 7/2008 | Perry et al. | |
| 2008/0156808 | A1 | 7/2008 | Perry et al. | |
| 2009/0039078 | A1 | 2/2009 | Sanfilippo et al. | |
| 2009/0177179 | A1 | 7/2009 | Engelbrecht | |
| 2009/0236346 | A1 | 9/2009 | Hofeldt et al. | |
| 2009/0314775 | A1 | 12/2009 | Dietrich et al. | |
| 2010/0018883 | A1 | 1/2010 | Patel | |
| 2010/0065557 | A1 | 3/2010 | Gersovitz | |
| 2010/0108670 | A1 | 5/2010 | Perry et al. | |
| 2010/0133127 | A1 | 6/2010 | Jenner | |
| 2010/0140129 | A1 | 6/2010 | Sanfilippo | |
| 2010/0142862 | A1 | 6/2010 | Sam | |
| 2010/0180553 | A1 | 7/2010 | Tilton | |
| 2010/0270301 | A1 | 10/2010 | Cronin | |
| 2010/0308044 | A1 | 12/2010 | Perry et al. | |
| 2010/0308065 | A1 | 12/2010 | Vandamme et al. | |
| 2010/0308066 | A1 | 12/2010 | Perry et al. | |
| 2010/0326987 | A1* | 12/2010 | Ferlito | F04B 53/1065 53/510 |
| 2011/0006066 | A1 | 1/2011 | Vandamme et al. | |
| 2011/0240666 | A1 | 10/2011 | Mihaylov | |
| 2011/0253725 | A1 | 10/2011 | Killian | |
| 2012/0103353 | A1 | 5/2012 | Sebastian et al. | |
| 2012/0125932 | A1 | 5/2012 | Sierra-Gomez | |
| 2012/0298733 | A1 | 11/2012 | Xu et al. | |
| 2013/0029823 | A1 | 1/2013 | Zoeckler | |
| 2013/0048125 | A1 | 2/2013 | Hoffman et al. | |
| 2013/0092312 | A1 | 4/2013 | Cassoni | |
| 2013/0186901 | A1 | 7/2013 | Lejon et al. | |
| 2014/0109522 | A1 | 4/2014 | Sanfilippo | |
| 2014/0215973 | A1 | 8/2014 | Hagelqvist | |
| 2014/0262903 | A1 | 9/2014 | Mitten | |
| 2014/0287901 | A1 | 9/2014 | Hagelqvist | |
| 2015/0038309 | A1 | 2/2015 | Hoffman et al. | |
| 2015/0041470 | A1 | 2/2015 | Huffer et al. | |
| 2015/0099616 | A1 | 4/2015 | Chapman et al. | |
| 2015/0148208 | A1 | 5/2015 | Sireix | |
| 2015/0158632 | A1 | 6/2015 | Wilhelm | |
| 2016/0000270 | A1 | 1/2016 | Wiggins et al. | |
| 2016/0137377 | A1 | 5/2016 | Tracy | |
| 2017/0073142 | A1 | 3/2017 | Loomis et al. | |
| 2017/0247159 | A1* | 8/2017 | Hansen | B32B 27/32 |
| 2017/0283136 | A1* | 10/2017 | Branyon | B32B 27/306 |
| 2017/0297769 | A1 | 10/2017 | Gersovitz | |
| 2018/0016038 | A1 | 1/2018 | Herlin et al. | |
| 2018/0022505 | A1 | 1/2018 | Herlin et al. | |
| 2018/0170613 | A1 | 6/2018 | Hu | |
| 2018/0194527 | A1 | 7/2018 | Sasaki et al. | |
| 2018/0229907 | A1 | 8/2018 | Gayer | |
| 2018/0237206 | A1 | 8/2018 | Jobe | |
| 2018/0311940 | A1 | 11/2018 | Toft et al. | |
| 2019/0127100 | A1 | 5/2019 | Herlin et al. | |
| 2019/0127107 | A1 | 5/2019 | Herlin et al. | |
| 2019/0135508 | A1 | 5/2019 | Sunning et al. | |
| 2019/0256230 | A1* | 8/2019 | Holka | B65B 1/02 |
| 2021/0070520 | A1 | 3/2021 | Huffer | |
| 2021/0206544 | A1 | 7/2021 | Holka et al. | |
| 2022/0135260 | A1 | 5/2022 | Larsson | |
| 2022/0363427 | A1 | 11/2022 | Andersson | |
| 2023/0054953 | A1 | 2/2023 | Graham | |

FOREIGN PATENT DOCUMENTS

| | | | | |
|---|---|---|---|---|
| CN | 1189804 | A | 8/1998 | |
| CN | 1914096 | A | 2/2007 | |
| CN | 2915695 | Y | 6/2007 | |
| CN | 101391493 | A | 3/2009 | |
| CN | 201338810 | | 11/2009 | |
| CN | 101754912 | | 6/2010 | |
| CN | 102190118 | A | 9/2011 | |
| CN | 101670909 | B | 1/2012 | |
| CN | 102991764 | A | 3/2013 | |
| CN | 103895952 | A | 7/2014 | |
| CN | 103979180 | A | 8/2014 | |
| CN | 104812680 | A | 7/2015 | |
| CN | 107108068 | A | 8/2017 | |
| CN | 206954829 | U | 2/2018 | |
| CN | 109153475 | A | 1/2019 | |
| CN | 208559788 | U | 3/2019 | |
| DE | 884862 | C | 7/1953 | |
| DE | 3411371 | A1 | 10/1985 | |
| DE | 10 2005 026903 | A1 | 8/2006 | |
| DE | 10 2011 014 844 | A1 | 9/2012 | |
| DE | 102012008397 | A1 * | 10/2013 | B65B 3/04 |
| DE | 10 2014 000 543 | A1 | 7/2015 | |
| EP | 0 013 132 | A1 | 7/1980 | |
| EP | 0 062 929 | A2 | 10/1982 | |
| EP | 0 094 359 | A2 | 11/1983 | |
| EP | 0 104 548 | B1 | 6/1987 | |
| EP | 0 312 513 | A2 | 4/1989 | |
| EP | 0 370 982 | A1 | 5/1990 | |
| EP | 0 611 703 | A2 | 8/1994 | |
| EP | 0 820 936 | A2 | 1/1998 | |
| EP | 1 052 181 | A1 | 11/2000 | |
| EP | 1818259 | A2 | 8/2007 | |
| EP | 1 842 792 | A1 | 10/2007 | |
| EP | 1 842 792 | B1 | 10/2008 | |
| EP | 1 035 025 | B1 | 3/2011 | |
| EP | 2986514 | A1 | 8/2013 | |
| EP | 2 716 551 | A1 | 4/2014 | |
| EP | 2 719 637 | A1 | 4/2014 | |
| EP | 2 731 874 | A1 | 5/2014 | |
| EP | 2 927 132 | A1 | 10/2015 | |
| EP | 3 085 636 | A1 | 10/2016 | |
| EP | 3 095 600 | A1 | 11/2016 | |
| EP | 3162553 | A1 | 5/2017 | |
| EP | 3 409 470 | A1 | 2/2018 | |
| EP | 3 342 720 | A1 | 7/2018 | |
| EP | 3 442 875 | | 2/2019 | |
| EP | 3 481 727 | | 5/2019 | |
| EP | 3 546 387 | | 10/2019 | |
| EP | 3 578 477 | | 12/2019 | |
| FR | 1358396 | A | 4/1964 | |
| FR | 828311 | A | 5/1983 | |
| FR | 2716408 | A1 | 8/1995 | |
| FR | 2 981 333 | | 4/2013 | |
| FR | 3043069 | | 5/2017 | |
| GB | 22536 | A | 10/1908 | |
| GB | 190722536 | A | 10/1908 | |
| GB | 1911 00947 | A | 12/1911 | |
| GB | 819960 | A | 9/1959 | |
| GB | 920354 | A | 3/1963 | |
| GB | 998102 | A | 7/1965 | |
| GB | 1038995 | A | 8/1966 | |
| GB | 2 281 895 | A | 3/1995 | |
| GB | 2 453 869 | A | 4/2009 | |
| GB | 2526548 | A1 | 12/2015 | |
| JP | S58-216539 | A | 12/1983 | |
| JP | S5962435 | A | 4/1984 | |
| JP | S60501305 | A | 8/1985 | |
| JP | S61217350 | A | 9/1986 | |
| JP | S6375 | A | 1/1988 | |
| JP | H0285118 | A | 3/1990 | |
| JP | H05-58640 | U | 8/1993 | |
| JP | H09-99939 | A | 4/1997 | |
| JP | H09-290822 | A | 11/1997 | |
| JP | 3025434 | B2 | 3/2000 | |
| JP | 2000-203612 | A | 7/2000 | |
| JP | 2001-030383 | | 2/2001 | |
| JP | 2003-231191 | | 8/2003 | |
| JP | 2004-001884 | A | 1/2004 | |
| JP | 2004-018100 | A | 1/2004 | |
| JP | 2004-026197 | A | 1/2004 | |
| JP | 2004-155478 | A | 6/2004 | |
| JP | 2004-315094 | A | 11/2004 | |
| JP | 2004-535993 | | 12/2004 | |
| JP | 2005-041515 | | 2/2005 | |
| JP | 2005-219319 | | 8/2005 | |
| JP | 2005-333802 | | 12/2005 | |
| JP | 3843510 | B2 | 11/2006 | |

(56) References Cited

FOREIGN PATENT DOCUMENTS

| | | | |
|---|---|---|---|
| JP | 2007-145415 | A | 6/2007 |
| JP | 2010-284866 | A | 12/2010 |
| JP | 2015-174690 | | 10/2015 |
| JP | 2016-084169 | A | 5/2016 |
| JP | 2016-088524 | A | 5/2016 |
| JP | 2016-179849 | A | 10/2016 |
| JP | 2017-074951 | A | 4/2017 |
| JP | 2019-137067 | | 8/2019 |
| JP | 6596835 | B2 | 10/2019 |
| JP | 2020-039532 | A | 3/2020 |
| KR | 10-2007-0113467 | | 11/2005 |
| RU | 2 188 783 | C2 | 9/2002 |
| SE | 453821 | B | 3/1988 |
| SE | 1651162 | A1 | 3/2018 |
| SU | 1433404 | A3 | 10/1988 |
| WO | WO 84/04511 | A1 | 11/1984 |
| WO | WO 87/03536 | A1 | 6/1987 |
| WO | WO 91/14623 | A1 | 10/1991 |
| WO | WO 03/039201 | | 5/2003 |
| WO | WO 2004/060767 | A1 | 7/2004 |
| WO | WO 2005/032959 | A1 | 4/2005 |
| WO | WO 2005/075314 | A2 | 8/2005 |
| WO | WO 2006/068585 | A1 | 6/2006 |
| WO | WO 2009/130043 | | 10/2009 |
| WO | WO 2020/211939 | A1 | 10/2010 |
| WO | WO 2011/052507 | A1 | 5/2011 |
| WO | WO 2013/009227 | A1 | 1/2013 |
| WO | WO 2013/057392 | A1 | 4/2013 |
| WO | WO 2013/109174 | A1 | 7/2013 |
| WO | WO 2014/062119 | A1 | 4/2014 |
| WO | WO 2015/145600 | | 10/2015 |
| WO | WO 2015/145601 | | 10/2015 |
| WO | WO 2015/187004 | A1 | 12/2015 |
| WO | WO 2014/011938 | A2 | 1/2016 |
| WO | WO 2016/030071 | A1 | 3/2016 |
| WO | WO 2016/034462 | A1 | 3/2016 |
| WO | WO 2016/126191 | A1 | 8/2016 |
| WO | WO 2016/126193 | A1 | 8/2016 |
| WO | WO 2017/180056 | A1 | 10/2017 |
| WO | WO 2018/009128 | A1 | 1/2018 |
| WO | WO 2018/009130 | A1 | 1/2018 |
| WO | WO 2018/009134 | A1 | 1/2018 |
| WO | WO 2018/009136 | A1 | 1/2018 |
| WO | WO 2018/009138 | A1 | 1/2018 |
| WO | WO 2018/217156 | A1 | 11/2018 |
| WO | WO 2019/068384 | A1 | 4/2019 |
| WO | WO 2019/226097 | A1 | 11/2019 |
| WO | WO 2020/261170 | A1 | 12/2020 |

* cited by examiner

METHOD OF PRODUCING PACKAGING CONTAINER COMPRISING A VALVE

CROSS-REFERENCE TO RELATED APPLICATION

The present application claims the benefit of Swedish Patent Application No. 2250621-6, filed on May 25, 2022.

INCORPORATION BY REFERENCE

The disclosure of Swedish Patent Application No. 2250621-6, filed on May 25, 2022, is hereby incorporated by reference for all purposes as if presented herein in its entirety.

TECHNICAL FIELD

The present disclosure pertains to a method of producing a packaging container for bulk solids.

BACKGROUND OF THE DISCLOSURE

Consumer goods, in particular bulk solids, are often packaged in relatively rigid paperboard packaging containers which protect the bulk solids during transport and storage at the manufacturer and retailer end and additionally during storage and dispensing at the consumer end. To keep the contents fresh and protected against contamination up until a first opening of the packaging container by a consumer, the containers may be provided with an inner transport closure which may be completely or partially removed by the consumer.

During transport of the packaging containers at higher altitudes and/or for packages comprising coffee which produces gas to some extent, a pressure above the ambient pressure may be obtained within said packaging container. Increased pressure in the inner compartment may also be a consequence of certain production methods upon pressing of the transport closure into the upper container body opening. The higher internal pressure leads to bulging transport seals and frequent peeling along the seal between the transport seal and the inner wall of the packaging container. It may also lead to bulging of the container walls and permanently deformed packaging containers. To avoid this problem, the packaging containers, and more specifically the transport closure, may for example be provided with a valve allowing gas to exit the inner compartment of the packaging container. It has however been found that the pressure build-up in the packaging may be faster than the initial release, i.e., the first opening of the valve in the transport closure.

An object of the present disclosure is to provide an improved packaging container with a reduced risk of deformation of the packaging container and damaged seals between the transport closure and the packaging container walls.

SUMMARY OF THE DISCLOSURE

One or more of the above objects may be achieved with a method of producing a packaging container in accordance with claim 1 and/or claim 14. Further embodiments are set out in the dependent claims, in the following description and in the drawings.

The present disclosure pertains to a method of producing a packaging container for bulk solids, the packaging container comprising an inner compartment and a transport closure closing the inner compartment, the transport closure comprising a top layer and a bottom layer, the top layer being provided with an opening, the transport closure being provided, on a first side of the transport closure, with a one-way pressure relief valve for allowing gas in the inner compartment of the packaging container to exit therefrom, the valve being arranged within the opening and on a side of the bottom layer facing the top layer, a surface area of the opening being greater than a surface area of the valve, the transport closure being provided with at least one through perforation covered by the valve on the first side of the transport closure, the method comprises the steps of:

a) forming a tubular container body, the container body having an upper end with an upper body opening and a bottom end with a bottom body opening and a container body wall extending in a height direction of the packaging container between the upper body opening and the bottom body opening, the container body wall having an inner surface and an outer surface, an upper end edge and a bottom end edge;

b) presenting the container body to an upper body opening sealing station comprising a plunger piston comprising a bottom plate, the bottom plate having a through hole extending from a first side of the bottom plate to a second side of the bottom plate;

c) applying the first side of the bottom plate against the first side of the transport closure such that the through hole of the bottom plate is arranged to at least partially overlap with the opening of the top layer, as seen in the height direction, and closing the upper body opening by pressing the transport closure with the plunger piston comprising the bottom plate into the upper body opening such that a pressure above an ambient pressure is produced within the tubular container body on a second side of the transport closure, allowing gas to exit the valve and the valve to be pre-conditioned; and d) attaching the transport closure to the inner surface of the container body wall.

When pressing down the transport closure comprising the valve into the container body, there may be a pressure build up in the inner compartment of the packaging container. To avoid this, excess gas may be allowed to be released from the packaging container at the sides of the transport closure. The solution of the present disclosure is instead to prevent gas to exit at the sides of the transport closure and provide the bottom plate of the plunger piston with a through hole, the through hole being arranged to partly or completely overlap with the opening of the top layer. When the transport closure is pressed down into the upper body opening, the pressure build-up will open the valve and release gas through the valve and into in the space provided by the opening of the top layer, i.e. between the first side of the transport closure and the bottom plate. The gas will subsequently exit via the through hole in the bottom plate and thereby reduce the internal pressure of the packaging container and the valve will be pre-conditioned. When the valve has been pre-conditioned, i.e. activated once, the required subsequent opening pressure may be lower and the gas flow through the valve may be larger in a shorter period of time. However, to precondition the valves prior to providing the transport closures into the packaging containers may imply higher production costs and a more complex production.

A surface area of the opening of the top layer may be at least 20% greater than a surface area of the valve, optionally the surface area of the opening is at least within the range from 20% to 250% greater than the surface area of the valve. The surface area of the opening of the top layer may be at least 25% greater than the surface area of the valve, such as at least 30% greater than the surface area of the valve. The surface area of the opening may be at least within the range from 25% to 200% greater than the surface area of the valve. Optionally, the surface area of the opening may be within the range from 25% to 150% greater than a surface area of the valve. The opening in the top layer of the transport closure may be accordingly optimized to provide a sufficient space for gas exiting the valve to prevent a too large pressure build up between the transport closure and the bottom plate before the gas escapes via the through opening of the bottom plate.

The thickness of the top layer is approximately the same or greater than the thickness of the valve. The thickness of the top layer may be from 10% greater than the thickness of the valve. Optionally, the thickness of the top layer may be from 20% greater than the thickness of the valve, such as from 20% to 400% greater. The thickness of the top layer may be from 30% greater than the thickness of the valve. This may provide a greater area outside the valve, a valve-free area, with less pressure applied by the bottom plate and where the gas may leak out from the valve prior to escaping via the through hole in the bottom plate.

The through hole may be arranged to, partly or completely, overlap with the valve-free area of the opening in the top layer, i.e., an area between an edge of the opening of the top layer and an edge of the valve.

The present disclosure additionally pertains to an alternative method of producing and filling a packaging container with bulk solids, the packaging container comprising an inner compartment and a transport closure closing the inner compartment, the transport closure being provided with a one-way pressure relief valve for allowing gas in the inner compartment of the packaging container to exit therefrom, the method comprises the steps of:

a) forming a container body, the container body having an upper end with an upper body opening and a bottom end with a bottom body opening and a container body wall extending in a height direction of the packaging container between the upper body opening and the bottom body opening, the container body wall having an inner surface;

b) presenting the container body to an upper body opening sealing station comprising a plunger piston comprising a bottom plate, the bottom plate having a through hole extending from a first side of the bottom plate to a second side of the bottom plate;

c) applying the first side of the bottom plate against the first side of the transport closure such that the through hole is arranged over the valve, and closing the upper body opening by pressing the transport closure with the plunger piston comprising the bottom plate into the upper body opening such that a pressure above an ambient pressure is produced within the tubular container body on a second side of the transport closure, allowing gas to exit the valve and the valve to be pre-conditioned; and d) attaching the transport closure to the inner surface of the container body wall.

In an interrelated manner with the first method, the second method provides a solution to the problem of pre-conditioning the valve provided in a transport closure of a packaging container. The solution of the second method is, similarly to the first method, to prevent gas to exit from the sides of the transport closure and to provide the bottom plate of the plunger piston with a through hole. In the second method the through hole allows the gas exiting the valve to escape through the through hole of the bottom plate. When the transport closure is pressed down into the upper body opening, the pressure build-up will open the valve and release gas through the valve such that gas may exit via the through hole in the bottom plate and the valve be pre-conditioned.

The transport closure in the second method may be a one layer or multilayer (such as a two-layer) transport closure. The transport closure may comprise one layer and the valve may be arranged on the first side of the top layer, facing away from the inner compartment from the packaging container. The transport closure may alternatively comprise a top layer and a bottom layer, optionally also one or more intermediate layers arranged between the top layer and the bottom layer, and the valve may be arranged on the first side of the top layer. In a further alternative, the transport closure may comprise a top layer and a bottom layer and the valve may be an integrated part of the top layer, such that the barrier layer of the valve is the same as the top layer and that the barrier layer has been separated from the remaining part of the top layer by scoring the top layer to separate the valve from the top layer.

The following is, if not otherwise is stated, applicable for both methods described herein.

The velocity of the plunger piston may be adapted and increased, or reduced, to control the pressure build-up. A suitable velocity may be within the range of from 100 to 400 mm/s, corresponding to 50 to 25 packaging containers per minute. If the pressure build up is too high the package integrity may be compromised. The plunger piston should press the transport closure into the upper body opening with a velocity such that the gas in the packaging container is compressed during pressing and the pressure in the inner compartments exceeds a set pressure where the valve opens to release excess gas.

As used herein, a paperboard sheet material is a material predominantly made from cellulose fibers or paper fibers. The sheet material may be provided in the form of a continuous web or may be provided as individual sheets of material. The paperboard material may be a single ply or multi ply material and may be a laminate comprising one or more layers of materials such as polymeric films and coatings, metal foil, etc. The polymeric films and coatings may include or consist of thermoplastic polymers. The paperboard materials as disclosed herein may also be referred to as cardboard or carton materials.

As used herein, the term "bulk solids" refers to a solid material. The bulk material may be dry or moist. The bulk solids may be in the form of particles, granules, grinds, plant fragments, short fibres, flakes, seeds, formed pieces of material such as pasta, etc. The bulk solids which are suitable for packaging in the packaging containers as disclosed herein may be flowable, which means that a desired amount of the product may be poured or scooped out of the packaging container, or in the form of discreet pieces of material allowing removal of only part of the content in the packaging container.

By a "pulverulent material" as used herein is implied any material in the form of particles, granules, grinds, plant fragments, short fibres, flakes, etc.

By a partly or fully removable transport closure is meant a member that may be fully or partly removed by a user in order to provide initial access to an interior compartment of the packaging container either by breaking a seal between the transport closure and the inner surface of the container wall, or by tearing or otherwise breaking the transport closure itself. Tearable transport closures may be provided with one or more predefined weakenings, such as perforations or a cut partly through the members.

A partly or fully removable transport closure may be gastight or gas-permeable. A gastight member may be manufactured from any material or material combination suitable for providing a gastight sealing of a compartment delimited by the transport closure, such as aluminium foil, silicon-coated paper, plastic film, or laminates thereof. A gastight member is advantageous when the bulk solids, such as pulverulent material, stored in the packaging container are sensitive to air and/or moisture, and it is desirable to avoid contact of the packaged bulk solids with ambient air. According to the present disclosure a gastight transport closure is preferred as the purpose is to produce and maintained a controlled pressure within the packaging container.

In the assembled and filled packaging container, which is disclosed herein, the peelable or openable transport closure forms a cross-sectional seal between an inner compartment in the container body and the container opening. The inner peelable or openable transport closure is a transport and storage seal which is eventually broken or removed by an end user of the packaging container.

A packaging container having a volume of approximately 11 may be considered gas-tight if it is a Modified Atmosphere Packaging (MAP).

By "ambient pressure" is meant the pressure surrounding the packaging container and which comes in contact with the packaging container.

Optionally, the valve includes an upper barrier layer and two elongated adhesive material strips, the two elongated adhesive material strips being arranged between the upper barrier layer and the first side of the transport closure and a respective side of the perforations in the transport closure, the valve further comprising a sealing lubricant, such as oil, applied over the perforations.

Optionally, the transport closure comprises a peripheral flange surrounding a transport closure base portion, the peripheral flange being flexed towards the upper end of the container body in the height direction. The transport closure may be attached to the packaging container by welding it to the inner surface of the container body wall. The transport closure may alternatively be attached by adhesive attachment. By providing the transport closure with a peripheral flange being flexed towards the upper end of the container, as seen in the height direction, it is further prevented that gas exits the inner compartment at the sides of the transport closure when pressing the transport closure into the upper opening, instead of building up a pressure on a second side of the transport closure, being an opposite side to the first side of the transport closure, so that the valve may easier be opened and pre-conditioned.

Optionally, a surface area of the bottom plate is equal to or not less than 85% of a surface area of the transport closure base portion, optionally equal to, or not less than 90%, or 95%, of a surface area of the transport closure base portion. This prevents gas to exit at the sides of the transport closure and at the sides of the plunger piston such that when the transport closure is pressed down into the upper body opening, pressure will build-up at the second side of the transport closure and exceed the set pressure where the valve is activated to release excess gas.

Optionally, step c) includes pressing the transport closure into the upper body opening with a length $L_1$ in said height direction, as measured between the top end edge and the transport closure base portion and wherein the length $L_1$ is 2 mm or more, such as within the range of from 2 mm and 50 mm. This may provide a controlled an improved pressure build-up to ensure that the valve is accurately preconditioned during the production of the packaging container.

Optionally, the sealing station comprises a guiding member forming an, as seen from the bottom end, upwardly extending guiding channel, the guiding channel extending away from the container body, in the height direction, with a length $L_2$, as measured from the top end edge, the length $L_2$ being within the range from 20 mm to 255 mm, and wherein step c) includes pressing the transport closure through the guiding channel and into the upper body opening. This may provide a controlled and improved pressure build-up to ensure that the valve is accurately activated and preconditioned during the production of the packaging container.

The sum of the length $L_1$ and the length $L_2$ may be from 22 mm, such as within the range of from 22 mm and 305 mm.

Optionally, step c) comprises that the size ratio of the transport closure surface area to the upper body opening surface area is at least 1.01:1, such that an outer edge portion of said bottom disc is shaped and flexed when said bottom disc is pressed into said body bottom opening, said outer edge portion of said bottom disc forming a flange projecting out of a main plane of said bottom disc, said flange being aligned with said inner surface of said container body wall. This prevents gas to exit from the sides of the transport closure such that when the transport closure is pressed down into the upper body opening, the pressure build-up will open the valve and release the pressure through the valve and the through hole in the bottom plate. Optionally, step c) comprises that the size ratio of the transport closure surface area to the upper body opening surface area is at least 1.05:1, such as 1.1:1.

Optionally, a minimum cross-section width of the through hole in the bottom plate is 4 mm such as at least 5 mm. Optionally, a minimum cross-section width of the through hole in the bottom plate is within the range of from 4 mm to 35 mm. Optionally, the through hole in the bottom plate is 7 mm or greater, such as 8 mm or 10 mm or greater. Optionally within the range of from 5 mm to 25 mm.

Alternatively, or additionally, the bottom plate may comprise two or more through holes, such as three or more through holes according to the present disclosure. The minimum cross-section width of the through holes in the bottom plate, if the bottom plate comprises two or more, or three or more though holes according to the present disclosure, may be 1 mm or 2 mm.

If the method is a method according to the second method, the through hole in the bottom plate may be at least 5% greater than the surface area of the valve, such as at least 8%, or at least 10% or at least 12% greater than the surface area of the valve. Optionally the surface area of the through hole in the bottom plate is within the range of 5% to 50% greater than the surface area of the valve.

Any one or the methods may be a method wherein the packaging container is filled with bulk solids into the upper body opening, the method then comprises a step prior to step b), of closing the container body bottom opening and presenting the container body to a filling station and filling bulk solids into the container body through the upper body opening.

Any one or the methods may be a method wherein the packaging container is filled with bulk solids into the bottom body opening. The method may then after step d), comprise the steps of turning the container body such that the bottom body opening is directed upwardly, presenting the container body to a filling station and filling bulk solids into the container body through the bottom body opening and finally closing the container body bottom opening. According to this variant of wherein the upper body opening is closed with the transport closure prior to filling the container body and closing the bottom body opening, the bottom body opening may be covered to prevent or reduce the amount of gas to exit from the bottom body opening while pressing the transport closure into the upper body opening, such as having a support surface under the bottom body opening of the container body while pressing the transport closure into the upper body opening of the container body.

BRIEF DESCRIPTION OF THE DRAWINGS

The present disclosure will be further explained hereinafter by means of non-limiting examples and with reference to the appended drawings wherein.

Like reference number denote similar features throughout the figures. Reference numbers may be omitted in some figures for better visibility, in which case reference is made to the other figures.

DETAILED DESCRIPTION

It is to be understood that the drawings are schematic and that individual components, such as layers of materials are not necessarily drawn to scale. The packaging container, transport closure, valve and plunger piston comprising the bottom plate shown in the figures are provided as examples only and should not be considered limiting to the disclosure. Accordingly, the scope of disclosure is determined solely by the scope of the appended claims.

Figure 1:
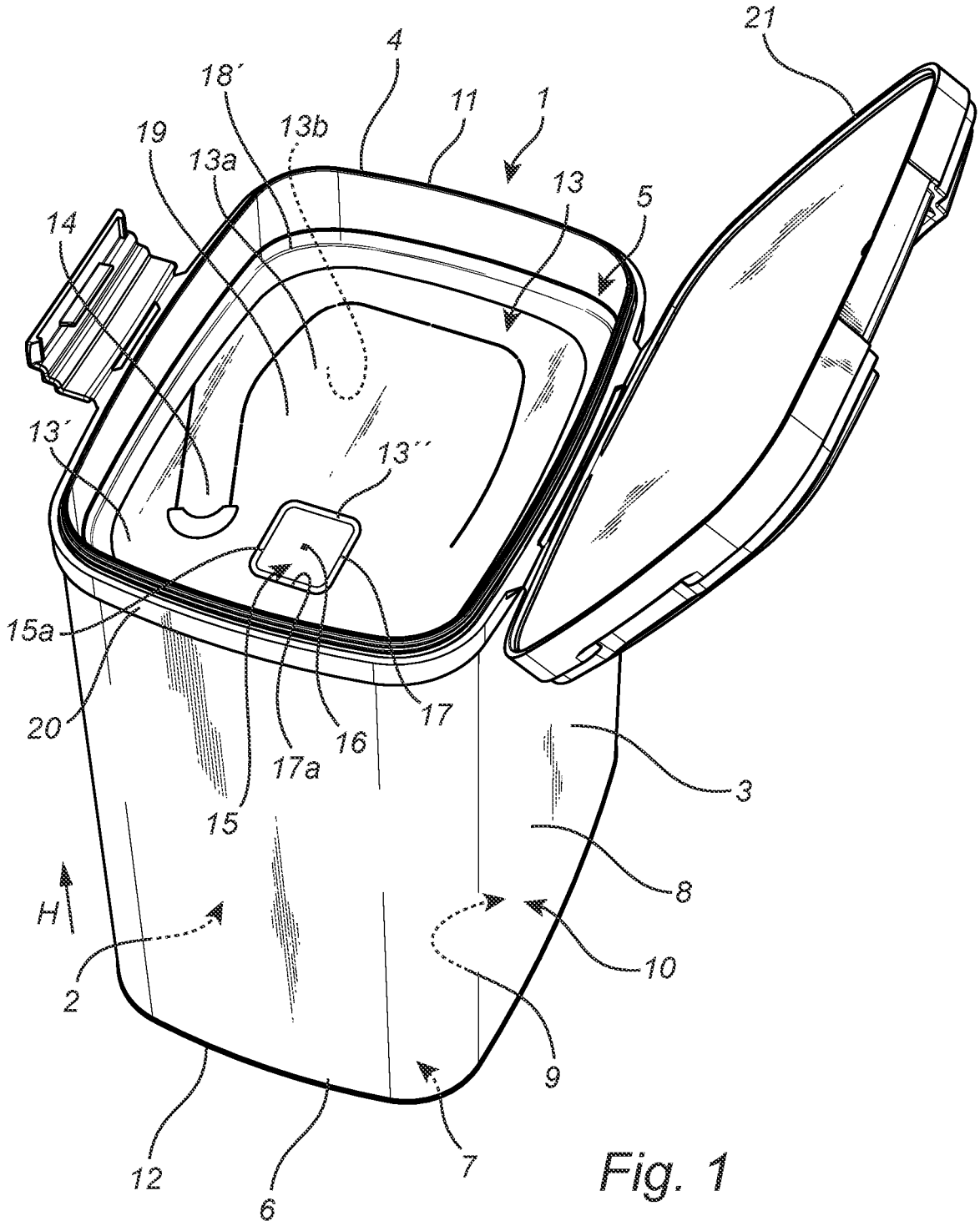
FIG. 1 illustrates a packaging container according to the present disclosure.

FIG. 1 illustrates a packaging container 1 for bulk solids, such as pulverulent material, obtained by a method according to the present disclosure. The particular shape of the container 1 shown in the figures should not be considered limiting to the disclosure. Accordingly, a packaging container produced according to the disclosure may have any useful shape or size.

Figure 3:
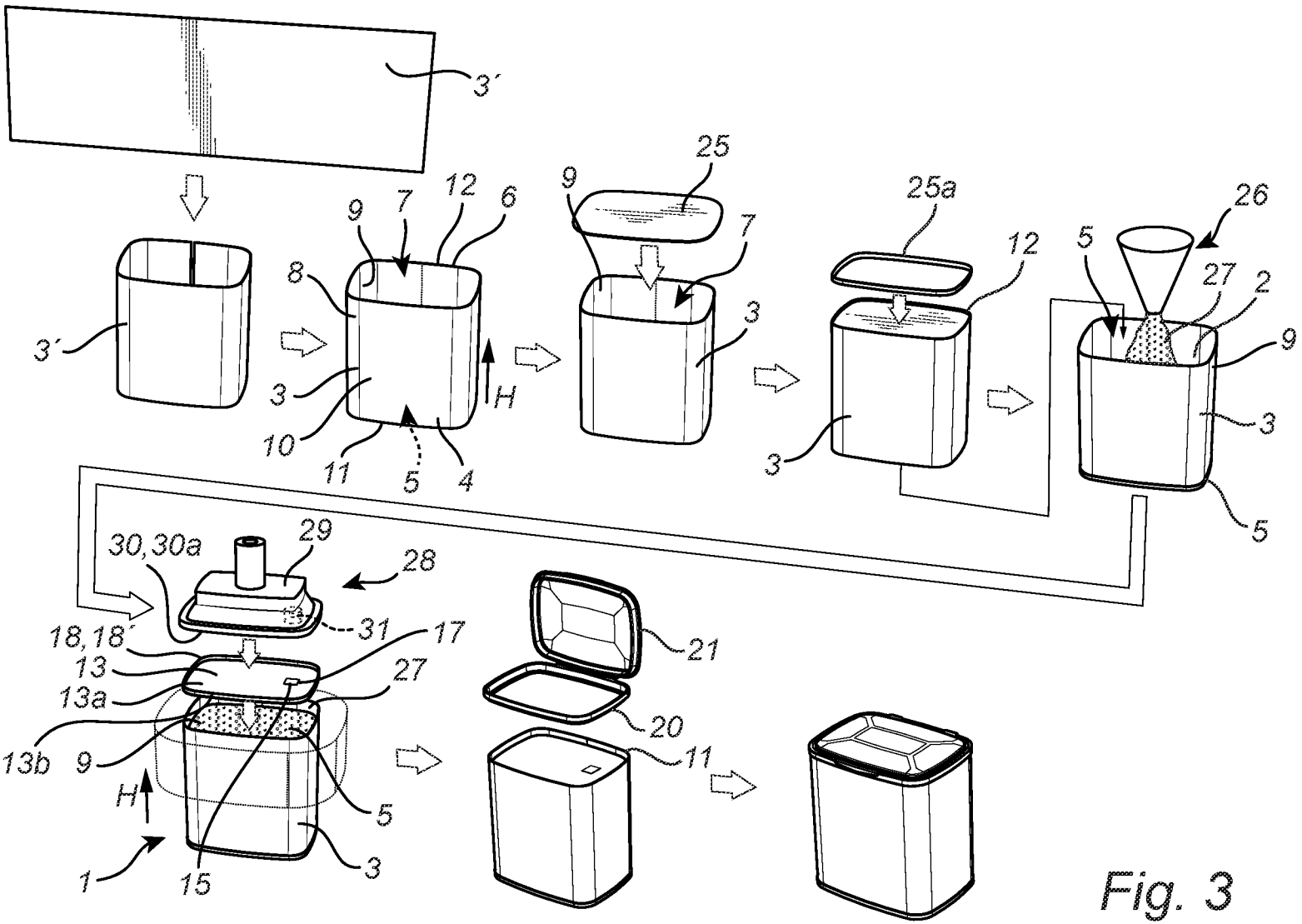
FIG. 3 shows schematically a method for producing and filling the packaging container in FIG. 1.

The packaging container 1 as illustrated in FIG. 1 comprises an inner compartment 2 comprising bulk solids (shown in FIG. 3). The packaging container 1 comprises a tubular container body 3 having an upper end 4 with an upper body opening 5 and a bottom end 6 with a bottom body opening 7. A container body wall 8 extends in a height direction H of the packaging container 1 between the upper body opening 5 and the bottom body opening 7. The container body wall 8 comprises an inner surface 9 and an outer surface 10, an upper end edge 11 and a bottom end edge 12.

A transport closure 13 is provided over the inner compartment 2, to keep the contents in the composite container fresh and protected against contamination up until a first opening of the packaging container 1 by a consumer. In this FIG. 1, the transport closure 13 is illustrated as an at least partly removable transport closure which may be removed by the end user by gripping the grip tab 14 and tearing off the transport closure 13. The transport closure 13 comprises a first side 13*a* and a second side 13*b*, the second side 13*b* facing the inner compartment 2 and the first side 13*a* facing away from the inner compartment 2.

The transport closure 13 is provided with a valve 15 on the first side 13*a* thereof. The valve 15 is a one-way pressure relief valve allowing gas in the inner compartment 2 to exit therefrom. The transport closure 13 is provided with through perforations 16 which are covered by the valve 15 and which perforations allow gas to exit from the inner compartment 2.

In FIG. 1, the transport closure 13 is a laminate transport closure 13 comprising a top layer 13' and a bottom layer 13" laminated together. The top layer 13' is provided with an opening 17 within which the valve 15 is arranged. A surface area of the opening 17 is greater than a surface area of the valve 15, such that an edge 17*a* of the opening 17 is arranged at a distance from an edge 15*a* of the valve 15, providing a valve-free area between the opening edge 17*a* and the valve edge 15*a*. The transport closure 13 is attached via an outer edge portion 18 (shown in FIG. 2) of the transport closure 13 surrounding a transport closure base portion 19 which has been flexed upwards during insertion forming a peripheral flange 18' during insertion of the transport closure 13 into the upper body opening 5 of the tubular container body 2. The peripheral flange 18' of the bottom layer 13" is attached to the inner surface 9 of the container body wall 8, such as by adhesive or by welding.

The container 1 is furthermore provided with a lid component including a top rim 20 and an openable and closable lid part 21.

When the lid is part of a lid component, it is connected to the top rim 20 by means of a hinge. The hinge may be a live hinge, i.e. a bendable connection between the lid part 21 and the top rim 20 or frame structure. A live hinge may be formed integrally with the lid and/or with the top rim or frame structure or may be a separately formed element which is attached to the lid and to the top rim or frame structure. Alternatively, the hinge may be a two-part hinge, with a first hinge part arranged on the lid and a second hinge part arranged on the top rim or frame structure.

The packaging container 1 is a container for dry or moist goods, often referred to as "bulk solids", in particular the bulk solids may be bulk solids emitting gas. Such products are non-liquid, generally particulate materials capable of being poured, scooped or taken by hand out of the cans.

The packaging container 1 is a disposable container, which are intended to be discarded after having been emptied of its contents.

Figure 2:
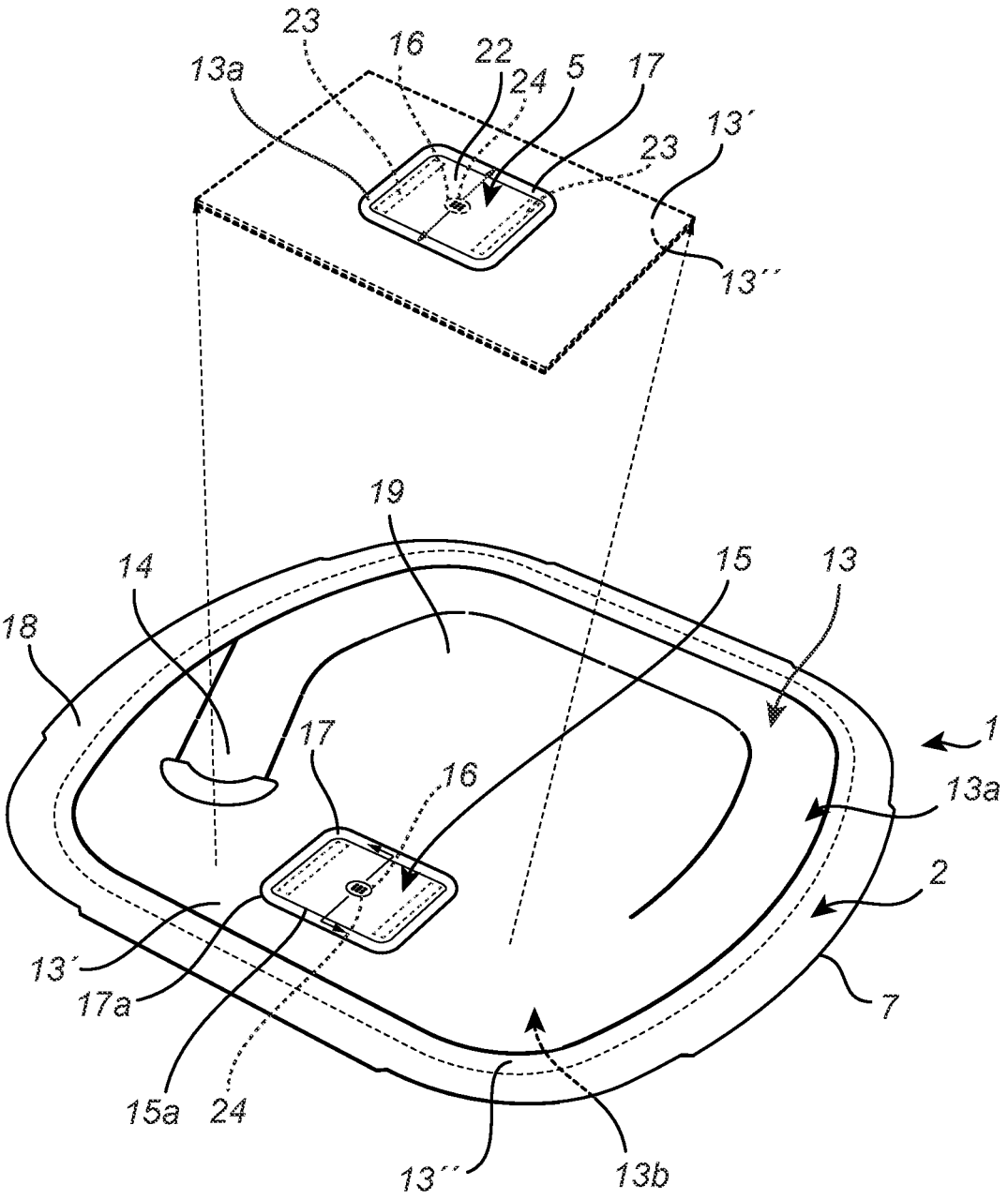
FIG. 2 shows a transport closure provided with a valve according to the present disclosure.

FIG. 2 illustrates the transport closure 13 from FIG. 1 prior to insertion into the packaging container 1 and prior to attachment to the inner surface 9 of the container body wall 8 (shown in FIG. 1). The bottom layer 13" of the transport closure 13 is intended to face the inner compartment 2 of the packaging container 1. The bottom layer 13" has a larger surface area than the top layer 13' and the outer edge portion 18 of the bottom layer 13" extends beyond the top layer 13' surrounding the transport closure base portion 19 forming a peripheral flange 18' (shown in FIG. 1) when being flexed upwardly during insertion of the transport closure 13 into the upper body opening 5 of the tubular container body 2 (shown in FIG. 1). The transport closure 13 is an at least partly removable transport closure which may be removed by the end user by gripping the grip tab 14 and tearing off the transport closure 13.

The valve 15 is arranged within the opening 17 of the top layer 13' of the laminate transport closure 13 and on the bottom layer 13", more specifically on a surface of the bottom layer 13" facing away from the inner compartment 2. A surface area of the opening 17 is greater than a surface area of the valve 15, such as at least 20% greater, optionally within the range from 20% to 200% greater. The valve 15 is arranged over opening 17, here provided in the bottom layer 13". The valve 15 may have a thickness of less than 600 μm. The thickness of the top layer 13' may be approximately the same or greater than the thickness of the valve 15. The thickness of the valve 15 may for example be in the range of 25% to 200% of the thickness of the top layer 13'. In absolute numbers the thickness of the valve 15 may be in the range of 150 μm to 600 μm. The thickness of the top layer 13' may be less than 600 μm, such as less than 500 μm, such as less than 300 μm, such as less than 200 μm, such as less than 150 μm. The top layer 13' may have an essentially uniform thickness.

The valve 15 illustrated in FIGS. 1 and 2 includes an upper barrier layer 22 and two elongated adhesive material strips 23 arranged between the upper barrier layer 22 and on the first side 13*a* of the transport closure 13 and on a respective lateral side of the perforations 16 in the transport closure 13. The valve 15 further comprises a sealing lubricant 24, such as oil, applied over the perforations 16.

The valve 15 is a pressure-relief valve allowing gas in the inner compartment 2 to exit therefrom, when the gas pressure inside exceeds the target pressure, by opening of the pressure-relief valve 15. When the gas exits the perforations 16 provided in the transport closure 13, the upper barrier layer 22 is pressed upwardly and the arrows shown in the figure indicates the gas passage during exit. It has been found by the present inventors, that when the valve 15 has been activated once, the required opening pressure may be lower and the gas flow through the valve may be larger in a shorter period of time, thus allowing an increasing internal pressure to be reduced faster. However, to precondition the valves prior to providing the transport closures into the packaging containers may imply higher production costs and a more complex production.

FIG. 3 discloses a method of producing and filling a packaging container 1 with bulk solids according to the present disclosure. In a first step, a tubular container body 3 is formed from a paperboard sheet 3' by bringing together the side edges of the paperboard sheet 3', thus causing the material to assume a tubular shape. The side edges of the paperboard sheet 3' are then sealed together thus forming a tubular container body 3. Sealing of the side edges may be made by any suitable method as known in the art, such as by welding or gluing, with welding being preferred. The side edges of the container body sheet 3' may be sealed using a sealing strip. The container body 3 has an upper end 4 with an upper body opening 5 and a bottom end 6 with a bottom body opening 7, the container body 3 is here shown with the bottom end 6 and the bottom body opening 7 directed upwardly. A container body wall 8 extends in a height direction H of the packaging container 1, between the upper body opening 5 and the bottom body opening 7, the container body wall 8 having an inner surface 9 and an outer surface 10, an upper end edge 11 and a bottom end edge 12. The method further comprising the step of closing the bottom body opening 7, here with a bottom disc 25 being pressed into the bottom body opening 7 and sealed against the inner surface 9 of the container body 3. Optionally, a bottom rim 25*a* may be attached to the bottom end edge 12 of the container body 3, alternatively, the bottom end edge may be curled inwards to form a curled bottom end edge. The container body 3 is then turned, such that the upper end 4 is directed upwards in the vertical direction and the bottom end 5 is directed downwards in the vertical direction. The method then comprises the step of presenting the container body 3 to a filling station 26 and filling bulk solids 27 into the container body 3 through the upper body opening 5. The container body 3 is subsequently presented to an upper body opening sealing station 28 comprising a plunger piston 29 including a bottom plate 30. The bottom plate 30 has a through hole 31 extending from a first side 30*a* of the bottom plate 30 to a second side 30*b* of the bottom plate 30 (shown in FIG. 4). The bottom plate 30 may extend in a direction substantially perpendicular to a pressing direction of the plunger piston 29. The bottom plate 30 may extend in a direction substantially perpendicular to the height direction H of the packaging container 1, that is substantially parallel to the top layer 17, when the packaging container 1 is presented to the upper body opening sealing station 28. The first side 30*a* and the second side 30*b* of the bottom plate 30 may be opposing sides. The through hole 31 may extend in the height direction H of the packaging container 1. The upper body opening 5 is closed by applying the bottom plate 30 against the first side 13*a* of the transport closure 13 and pressing the transport closure disc 13 as illustrated in FIG. 2, by means of the plunger piston 29 comprising the bottom plate 30 into the upper body opening such that a pressure above an ambient pressure is produced within the packaging container 1 and at the second side 13*b* of the transport closure 13. The first side 30*a* of the bottom plate 30 being applied against the first side 13*a* of the transport closure 13 such that the through hole 31 of the bottom plate 30 is arranged to partly or completely overlap with the opening 17 of the top layer 13', as seen in the height direction H, allowing gas to exit the valve 15 and the valve 15 to be pre-conditioned.

A surface area of the plunger piston 29 and/or bottom plate 30 may be equal to or not less than 85% of a surface area of the transport closure base portion 19, optionally equal to, or not less than 90% of a surface area of the transport closure base portion 19. Such size ratios may prevent gas from escaping from the inner compartment at the edges of the transport closure 13 and the plunger piston 29 and/or bottom plate 30.

To further prevent air to exit the inner compartment 2 between the transport closure 13 and the inner surface 9 of the container body 8 when pressing the transport closure into upper body opening, a size ratio of the surface area of the transport closure 13 to a surface area of the upper body opening 5 surface area may be at least 1.01, such that the outer edge portion 18 of the transport closure 13 is shaped and flexed when the transport closure 13 is pressed into the upper body opening 5. The outer edge portion 18 of transport closure forming a peripheral flange 18' projecting out of a main plane of the transport closure 13, the peripheral flange 18' being aligned with the inner surface 9 of the container body wall 8.

In FIG. 3, a lid component including a top rim 20 and an openable and closable lid part 21 is connected to the packaging container 1 by connecting the top rim 20 to the upper end edge 11. The top rim 20 may for example be attached by adhesive or by welding.

Figure 4:
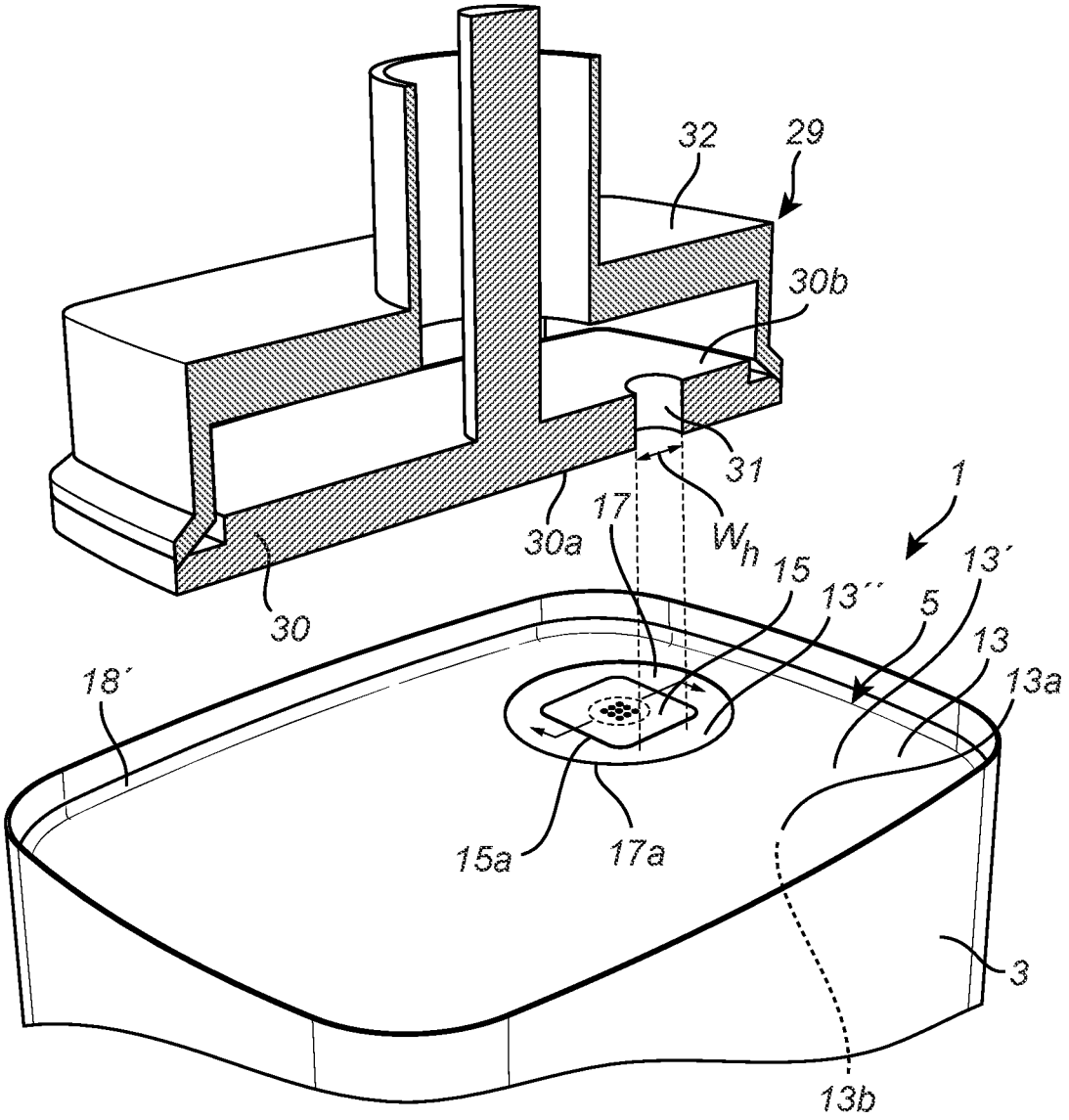
FIG. 4 shows an upper section of the packaging container and a cross-sectional view of the plunger piston after pressing the transport closure disc into and closing the upper body opening according to the present disclosure.

FIG. 4 illustrates an upper part of the packaging container 1 and a cross-sectional of the plunger piston 29 from the method step in FIG. 3 of closing the upper body opening of the packaging container 1. As shown in this figure, the plunger piston 29 comprising the bottom plate 30 has pressed the transport closure 13 into the upper body opening 5. The plunger piston 29 may include a plunger 32 made in a flexible material, such as rubber, which presses the peripheral flange 18' against the inner surface 9 of the tubular body 3. The through hole 31 in the bottom plate 30 may have a minimum cross-section width Wh of 4 mm, such as within the range of from 4 mm to 35 mm, such as within the range of from 5 mm to 25 mm. Alternatively, or additionally, the bottom plate may comprise two or more through holes, such as three or more through holes according to the present disclosure. The minimum cross-section width of the through holes in the bottom plate, if the bottom plate comprises two or more, or three or more though holes according to the present disclosure, may be 1 mm or 2 mm.

In FIG. 4, the transport closure 13 comprises a top layer 13' and a bottom layer 13", the top layer 13' being provided with an opening 17, the valve 15 being arranged within the opening 17 and on the bottom layer 13", more specifically on a surface of the bottom layer 13" facing the top layer 13'. The through hole 31 in the bottom plate 30 is arranged to at least partly overlap with the opening 17 of the top layer 13' of the transport closure. The through hole 31 may be arranged to partly or completely overlap with a valve-free area of the opening 17, i.e., an area between an edge 17*a* of the opening 17 and an edge 15*a* of the valve 15.

Figure 5:
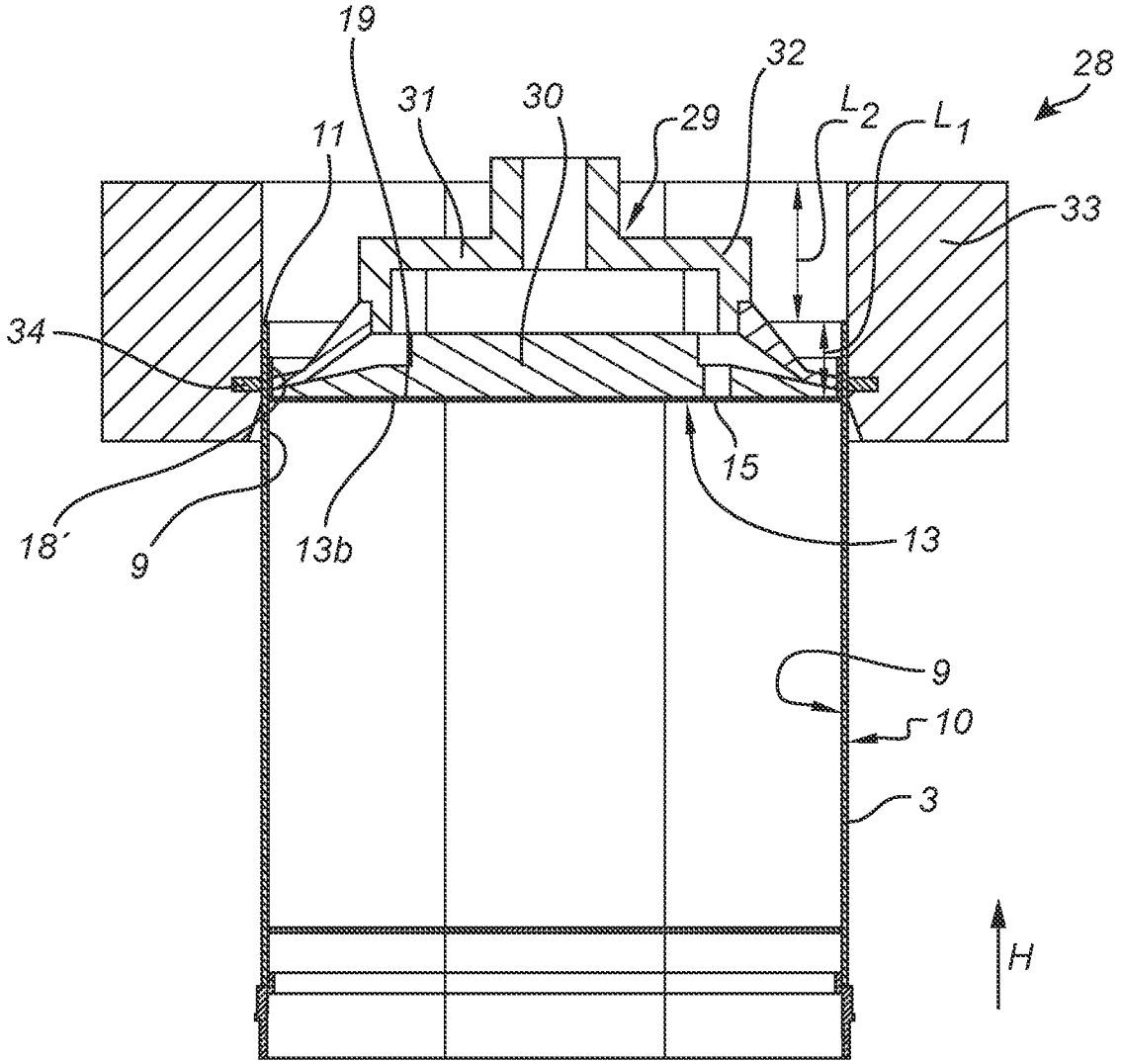
FIG. 5 shows a cross-sectional view of a packaging container during pressing of the transport closure disc into the upper body opening and wherein the sealing station comprises a guiding member according to the present disclosure.

FIG. 5 illustrates an optional step of the method according to the present disclosure wherein the transport closure 13 is pressed into the upper body opening 5 with a length $L_1$ in the height direction H, as measured between the upper end edge 11 and the transport closure base portion 19, the length $L_1$ may be 2 mm or more, such as within the range of from 2 mm and 50 mm.

In FIG. 5, the upper body sealing station 28 comprises a guiding member forming an, as seen from the upper end 4, upwardly extending guiding channel 33, the guiding channel 33 extending away from the container body 3, in the height direction H, with a length $L_2$, as measured from the upper end edge 11 of the container body 3. The length $L_2$ is at least 20 mm. The transport closure 13 is pressed through the guiding channel 33 and into the upper body opening 5, thus providing a higher pressure at the second side 13*b* of the transport closure 13 for preconditioning of the valve 15. The plunger piston 29 includes the bottom plate 30 comprising the through hole 31 and the plunger 32 made in a flexible material, such as rubber, which presses the peripheral flange 18' against the inner surface 9 of the tubular body 3. The peripheral flange 18' is attached by welding members 34.

The sum of the length $L_1$ and the length $L_2$ may be from 22 mm, such as within the range of from 22 mm and 305 mm.

The invention claimed is:

1. A method of producing a packaging container for bulk solids, the packaging container comprising an inner compartment and a transport closure closing the inner compartment, the transport closure comprising a top layer and a bottom layer, the bottom layer facing the inner compartment, the top layer being provided with an opening, the transport closure being provided, on a first side of the transport closure, with a one-way pressure relief valve for allowing gas in the inner compartment of the packaging container to exit therefrom, the valve being arranged within the opening and on a side of the bottom layer facing away from the inner compartment, a surface area of the opening being greater than a surface area of the valve, the transport closure being provided with at least one through perforation covered by the valve on the first side of the transport closure, the method comprises the steps of:

a) forming a tubular container body, the container body having an upper end with an upper body opening and a bottom end with a bottom body opening and a container body wall extending in a height direction of the packaging container between the upper body opening and the bottom body opening, the container body wall having an inner surface and an outer surface, an upper end edge and a bottom end edge;

b) presenting the container body to an upper body opening sealing station comprising a plunger piston comprising a bottom plate, the bottom plate having a through hole extending from a first side of the bottom plate to a second side of the bottom plate, the first and second sides being opposing sides;

c) applying the first side of the bottom plate against the first side of the transport closure such that the through hole of the bottom plate is arranged to at least partially overlap the opening of the top layer and closing the upper body opening by pressing the transport closure with the plunger piston comprising the bottom plate into the upper body opening such that a pressure above an ambient pressure is produced within the tubular container body on a second side of the transport closure, allowing gas to exit the valve and the valve to be pre-conditioned; and d) attaching the transport closure to the inner surface of the container body wall.

2. The method according to claim 1, wherein the surface area of the opening of the top layer is at least 20% greater than the surface area of the valve.

3. The method according to claim 1, wherein the valve includes an upper barrier layer and two elongated adhesive material strips.

4. The method according to claim 3, wherein the two elongated adhesive material strips are arranged between the upper barrier layer and the first side of the transport closure and on respective lateral sides of the at least one perforation in the transport closure.

5. The method according to claim 4, wherein the valve further comprises a sealing lubricant applied over the at least one perforation.

6. The method according to claim 1, wherein the transport closure comprises a peripheral flange surrounding a transport closure base portion, the peripheral flange being flexed towards the upper end of the container body in the height direction.

7. The method according to claim 6, wherein a surface area of the bottom plate is at least 85% of a surface area of the transport closure base portion.

8. The method according to claim 6, wherein step c) includes pressing the transport closure into the upper body opening with a length L1 in said height direction, as measured between the upper end edge and the transport closure base portion and wherein the length L1 is at least 2 mm.

9. The method according to claim 1, wherein the sealing station comprises a guiding member forming a guiding channel, the guiding channel extending away from the container body, in the height direction, with a length L2, as measured from the upper end edge, the length L2 is at least 20 mm and wherein step d) includes pressing the transport closure through the guiding channel and into the upper body opening.

10. The method according to claim 1, wherein step c) comprises that the size ratio of a surface area of the transport closure to a surface area of the upper body opening is at least 1.01:1, such that an outer edge portion of the transport closure is shaped and flexed when the transport closure is pressed into the upper body opening, the outer edge portion of the transport closure forming a peripheral flange projecting out of a main plane of the transport closure, the peripheral flange being aligned with the inner surface of the container body wall.

11. The method according to claim 1, wherein a minimum cross-section width of the through hole in the bottom plate is at least 4 mm.

12. The method according to claim 1, wherein the method is a method for producing and filling a packaging container with bulk solids, wherein the method prior to step b), comprises the steps of closing the container body bottom opening and presenting the container body to a filling station and filling bulk solids into the container body through the upper body opening.

13. A method of producing a packaging container for bulk solids, the packaging container comprising an inner compartment and a transport closure closing the inner compartment, the transport closure being provided with a one-way pressure relief valve for allowing gas in the inner compartment of the packaging container to exit therefrom, the method comprises the steps of:

a) forming a container body, the container body having an upper end with an upper body opening and a bottom end with a bottom body opening and a container body wall extending in a height direction of the packaging container between the upper body opening and the bottom body opening, the container body wall having an inner surface;

b) presenting the container body to an upper body opening sealing station comprising a plunger piston comprising a bottom plate, the bottom plate having a through hole extending from a first side of the bottom plate to a second side of the bottom plate;

c) applying the first side of the bottom plate against a first side of the transport closure such that the through hole is arranged over the valve, and closing the upper body opening by pressing the transport closure with the plunger piston comprising the bottom plate into the upper body opening such that a pressure above an ambient pressure is produced within the tubular container body on a second side of the transport closure, allowing gas to exit the valve and the valve to be pre-conditioned; and d) attaching the transport closure to the inner surface of the container body wall.

14. The method according to claim 13, wherein the transport closure has at least one through perforation covered by the valve on the first side of the transport closure, the first side of the transport closure facing away from the inner compartment.

15. The method according to claim 14, wherein the valve includes an upper barrier layer and two elongated adhesive material strips.

16. The method according to claim 15, wherein the two elongated adhesive material strips are arranged between the upper barrier layer and the first side of the transport closure and on respective lateral sides of the at least one perforation in the transport closure.

17. The method according to claim 16, wherein the valve further comprises a sealing lubricant applied over the at least one perforation.

18. The method according to claim 13, wherein the valve has a thickness of less than 600 pm.

19. The method according to claim 13, wherein a surface area of the through hole is greater than a surface area of the valve.

20. The method according to claim 13, wherein the transport closure comprises a peripheral flange surrounding a transport closure base portion, the peripheral flange being flexed towards the upper end of the container body in the height direction.

21. The method according to claim 20, the container body wall having an upper end edge, wherein step c) includes pressing the transport closure into the upper body opening with a length L1 in said height direction, as measured between the upper end edge and the transport closure base portion and wherein the length L1 is at least 2 mm.

22. The method according to claim 21, wherein the sealing station comprises a guiding member forming a guiding channel, the guiding channel extending away from the container body, in the height direction, with a length L2, as measured from the upper end edge, the length L2 is at least 20 mm and wherein step d) includes pressing the transport closure through the guiding channel and into the upper body opening.

23. The method according to claim 13, wherein an outer edge portion of the transport closure is shaped and flexed when the transport closure is pressed into the upper body opening, the outer edge portion of the transport closure forming a peripheral flange projecting out of a main plane of the transport closure, the peripheral flange being aligned with the inner surface of the container body wall.

24. The method according to claim 13, wherein the method is a method for producing and filling a packaging container with bulk solids, wherein the method comprises the steps of closing the container body bottom opening and presenting the container body to a filling station and filling bulk solids into the container body through the upper body opening.

* * * * *